US007264144B2

(12) United States Patent
Morris

(10) Patent No.: US 7,264,144 B2
(45) Date of Patent: Sep. 4, 2007

(54) TOP CONE FOR AN AEROSOL CAN, AND AEROSOL CAN PROVIDED WITH THE SAME

(75) Inventor: Alan John Morris, Swansea (GB)

(73) Assignee: Corus Staal BV, Ijmuiden (NL)

( * ) Notice: Subject to any disclaimer, the term of this patent is extended or adjusted under 35 U.S.C. 154(b) by 303 days.

(21) Appl. No.: 10/494,270

(22) PCT Filed: Jul. 24, 2002

(86) PCT No.: PCT/EP02/08327

§ 371 (c)(1),
(2), (4) Date: Jan. 19, 2005

(87) PCT Pub. No.: WO03/039995

PCT Pub. Date: May 15, 2003

(65) Prior Publication Data

US 2005/0127112 A1 Jun. 16, 2005

(30) Foreign Application Priority Data

Nov. 5, 2001 (EP) ..... 01204207
Nov. 5, 2001 (NL) ..... 1019289

(51) Int. Cl.
*B65D 83/00* (2006.01)

(52) U.S. Cl. ..... 222/402.1; 222/397; 220/619; 220/623; 220/689

(58) Field of Classification Search ..... 222/402.1, 222/397, 401; 220/619, 623, 620, 689, 624
See application file for complete search history.

(56) References Cited

U.S. PATENT DOCUMENTS

| | | | | |
|---|---|---|---|---|
| 2,426,550 | A * | 8/1947 | Coyle | 220/619 |
| 3,074,602 | A | 1/1963 | Shillady | |
| 3,850,339 | A | 11/1974 | Kinkel | |
| 4,418,846 | A | 12/1983 | Pong et al. | |
| 4,775,071 | A * | 10/1988 | Giggard | 220/619 |
| 5,211,317 | A | 5/1993 | Diamond et al. | |
| 5,636,761 | A | 6/1997 | Diamond et al. | |
| 5,938,067 | A * | 8/1999 | Diamond et al. | 220/619 |
| 5,954,239 | A | 9/1999 | Evans et al. | |
| 6,408,498 | B1 * | 6/2002 | Fields et al. | 29/243.5 |

* cited by examiner

*Primary Examiner*—Frederick C. Nicolas
(74) *Attorney, Agent, or Firm*—Stevens, Davis, Miller & Mosher, LLP

(57) ABSTRACT

Top cone for an aerosol can, including a formed metal sheet extending around a longitudinal central axis, and having a contour that includes, as seen in longitudinal cross section from the top downward, a top section intended for holding a valve cap, a cone section connected to the top section and leading to a countersink section and a flange section. The countersink section is essentially U-shaped whereby the outer leg of the essential U-shape, that is the leg being furthest removed from the central axis, is bent away from the central axis to form the flange section, and which cone section has a continuously increasing transversal diameter, wherein the top cone comprises strengthening means for strengthening the countersink section against pivoting toward the central axis.

8 Claims, 4 Drawing Sheets

FIG. 1
Prior Art
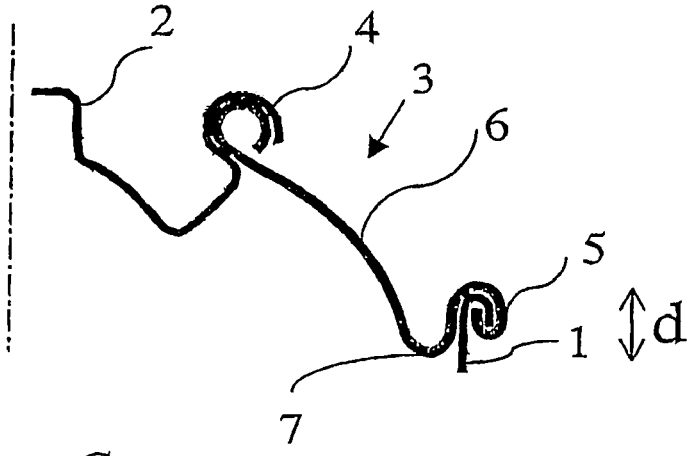
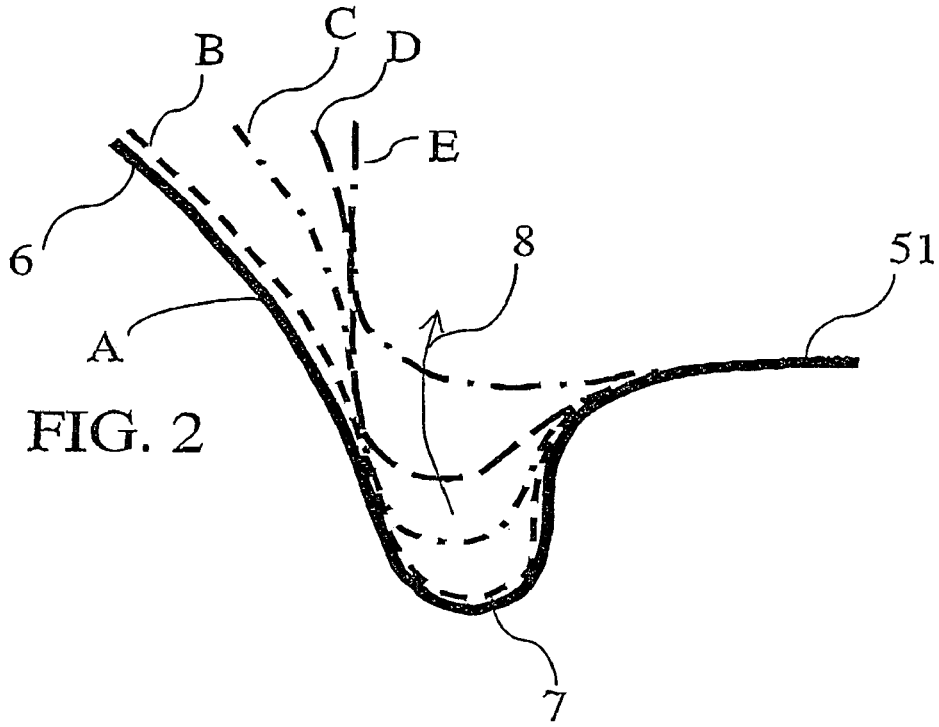
FIG. 2
FIG. 3
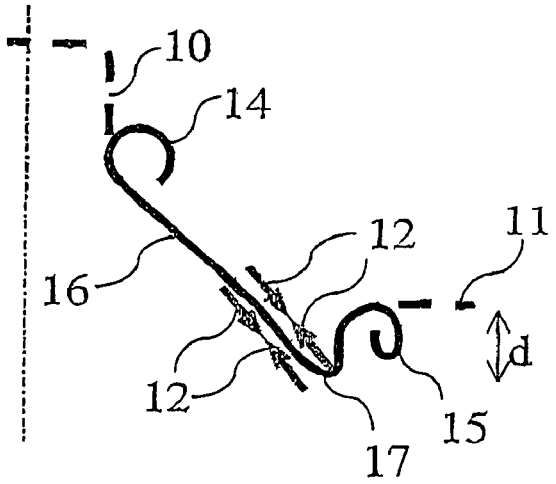

TOP CONE FOR AN AEROSOL CAN, AND AEROSOL CAN PROVIDED WITH THE SAME

The invention relates to a top cone for an aerosol can, comprising a formed metal sheet extending around a longitudinal central axis, and having a contour that comprises, as seen in longitudinal cross section from the top down ward, a top section intended for holding a valve cap, a cone section that is connected to the top section and leading to a countersink section and a flange section, which countersink section is essentially U-shaped whereby the outer leg of the essential U-shape, that is the leg being furthest removed from the central axis, is bent away from the central axis to form the flange section, and which cone section has a continuously increasing transversal diameter.

In particular, the invention relates to a reversible top cone in accordance with the top cone as defined, in general terms, above.

Within the scope of this description, the term U shaped is to be understood to include a contour of which the legs are not mutually parallel with to other, such as is the case in a V shape.

Within the scope of this description, the term top cone is to be understood to include a semi product that has not yet been beaded or flanged, but nevertheless having sections suitable for these purposes.

A typical top cone for an aerosol can is shown in U.S. Pat. No. 4,418,846. The typical top cone is formed of metal sheet, has a beaded top section to hold a valve cap, a cone section that is generally shaped outwardly convex, and a flange section that is connected to the cone section via a countersink section that is generally U-shaped. The top cone is secured to a body of an aerosol can via the flange section.

The aerosol can is usually filled under a pressure. When the pressure inside the aerosol can increases, the volume inside the top cone should, for safety reasons, increase as a result of the cone section moving outward, resulting in reduction of the pressure. When the pressure gets too high, that is when the pressure exceeds a so called reversal pressure, the cone will undergo plastic deformation. This is generally referred to as reversal failure.

There is a continuous strife to reduce the weight of the aerosol can and consequently also that of the top cone, the top cone being a component for the aerosol can. However, there are constraints to be complied with, amongst which are that the diameter of the flange section should match the diameter of the body of the aerosol can, the valve cap size is often fixed, and a certain desired reversal pressure is to be achieved.

It is an object of the invention to reduce the weight of the aerosol top cone and to provide an aerosol can having such a top cone.

According to the invention, at least one of these objects is achieved with a top cone, in particular a reversible top cone, for an aerosol can, comprising a formed metal sheet extending around a longitudinal central axis, and having a contour that comprises, as seen in longitudinal cross section from the top downward, a top section intended for holding a valve cap, a cone section that is connected to the top section and leading to a countersink section and a flange section, which countersink section is essentially U-shaped whereby the outer leg of the essential U-shape, that is the leg being furthest removed from the central axis, is bent away from the central axis to form the flange section, and which cone section has a continuously increasing transversal diameter, whereby the top cone comprises strengthening means for strengthening the countersink section against pivoting toward the central axis.

It has been found that by providing such strengthening means, the resistance against reversal failure is improved. Consequently, by providing the strengthening means for the countersink section, it is possible to use a generally thinner gauge material to obtain a top cone with a similar reversal pressure as was the case for the typical top cone.

From studying aerosol top cone failure of the typical aerosol top cone, it was noted that in the onset of pressure reversal, the countersink rolled inwards into the aerosol can, pivoting around an upper portion of the countersink. The measure of strengthening the countersink section against pivoting toward the central axis is based on this understanding.

The strengthening means should not completely block the countersink from pivoting, but the strengthening means should reduce the ease of the pivoting action. Otherwise, the top cone will not sufficiently increase the enclosed volume of the aerosol can in response to a pressure increase.

The strengthening means can be achieved by, for instance, provision of a reinforcement ring in the countersink, or a local thickening of the gauge in the countersink section allowing for reduction of the thickness outside the countersink section such that the over all weight is reduced. Preferred means will be described in more detail below.

In a preferred embodiment, the top cone is shaped to strengthen the countersink section against pivoting toward the central axis.

By shaping the top cone to strengthen the countersink section, the need for using separate means for this purpose is avoided.

In an embodiment of the invention, the strengthening against the inward pivoting of the countersink is at least in part achieved if the cone section is shaped to brace the counter sink section against pivoting toward the central axis.

It has been found that especially the design of the cone section can serve to provide a higher resistance against reversal failure by bracing the countersink section, when other conditions, such as type of material and the thickness of the top cone material and over all size of the top cone, are kept the same. Consequently, it is now possible to use a thinner gauge to obtain a top cone with a similar reversal pressure as was the case for the typical top cone.

In a preferred embodiment, the strengthening means comprises the cone section following essentially a straight trajectory whereby a bottom part of the cone section forms the inner leg of the essentially U-shaped countersink section. It is currently believed that the top cone design according to this embodiment of the invention offers good bracing resistance against the pivoting movement of the countersink section, thereby increasing the pressure required to cause structural failure of the aerosol top cone. Consequently, it is now possible to use a thinner gauge to obtain a top cone with a similar reversal pressure as was the case for the typical top cone.

It is remarked that a top cone having a section with a straight trajectory is shown in U.S. Pat. No. 5,954,239. In this top cone the cone section is connected to the U-shaped countersink section via a sharp bend, whereby the legs of the U-shape run essentially parallel to the longitudinal axis of the aerosol can. Thus, the pivoting action of the countersink section is not effectively braced by the cone section. For the bracing function of the cone section, it is essential that the bottom part of the cone section is part of the U shaped countersink section by forming one of its legs.

The top cone according to the invention can be manufactured from a metal blank, preferably cut or stamped in the shape of a circular disc, using a multi step press forming process involving cupping the blank further moulding. The metal may be aluminum or packaging steel, in particular tinplate steel, of which the steel-based variants are preferred.

An additional advantage of the top cone having the cone section that follows the essentially straight trajectory, is that for a certain blank size and top cone cross section, the depth of the countersink can be increased because the straight shape consumes less material. A deeper countersink has been found to further improve the reversal pressure.

In an embodiment of the invention, the cone section is provided locally with an essentially circumferential weak section relative to the remaining parts of the cone section. Herewith, the reversal pressure can be set more accurately to a desired value. Moreover, the reversal failure proceeds in a more controlled manner and in a safer way despite occurring at a higher pressure.

Due to the relatively weak section, the cone itself will be lifted upwards when the pressure exceeds the reversal pressure, thereby causing the cone to buckle at the position of the weaker section. Consequently, the supporting effect of the cone section on the countersink section is removed, allowing the countersink section to pivot with relative ease in a progressive plastic reversal failure.

Preferably, the locally weak section is at least partly formed by a stress damaged region. Such a stress damaged region is relatively easy to provide by locally bending and subsequently unbending the material to cause the stress damage. Due to stress damage being essentially invisible on the outside of the top cone it is very attractive. The local bending can already be effected during a first cupping step of producing the top cone from the metal blank.

In a preferred embodiment, the U-shaped counter sink is formed by an outwardly convex section connecting the two legs, the outwardly convex section having a relatively small radius so that the U-shape of the counter sink is essentially close to a V-shape. The V-shaped countersink section is found to stiffen the countersink section, resulting in a sufficiently rigid countersink region to still pivot about the seam during the onset of cone reversal. Thus a safe progressive plastic roll-through upon final failure is maintained.

Preferably, the radius of the convex section is smaller than 0.90 mm. More preferably it is smaller than 0.70 mm, and even molt preferably it is smaller than 0.50 mm. It has been found that the reversal pressure is somewhat improved when the radius lies in the range between 0.90 mm and 0.70 mm; a more significant improvement has been found for a radius smaller than 0.70 mm. Surprisingly, a relatively strong improvement has been found when the radius is smaller than 0.50 mm.

Preferably, the metal blank from which the top cone is manufactured is a polymer pre-coated metal blank. Because the blank is pre-coated with a polymer film; the coating layer is relatively robust against crackling. Thus, the countersink radius can be relatively small.

In a second aspect, the invention relates to an aerosol can. The aerosol can according to this aspect of the invention comprises a body having a side wall that, on a bottom end, is provided with an end closure, and, connected to the end of the side wall opposite to the bottom end, a top cone according to one of the previous claims, the top cone being provided with a valve cap.

It is not material to the invention whether the top cone is integral to the aerosol can or a separate piece that is connectable or connected to the aerosol can. The end closure on the bottom of the aerosol can can be integrally connected to the side wall, or it can be a separate component that is connected to the side wall, by for instance a sealed or flanged section. In the latter case, the top cone may be integrally connected to the side wall.

It may also be possible to incorporate both the top cone in accordance with the invention as well as the bottom integral to the side wall in a one piece aerosol can.

The invention will now be explained with reference to the drawing wherein

FIG. 1 schematically shows a longitudinal cross section of an aerosol can showing the typical top cone according to the prior art;

FIG. 2 schematically shows the pivoting action of the countersink of the typical top cone;

FIG. 3 schematically shows a cross section of the top cone according to the invention, and of an intermediate product;

FIG. 4 schematically shows tooling for forming a top cone according to an embodiment of the invention, out of a cupped blank;

Figure 4A:
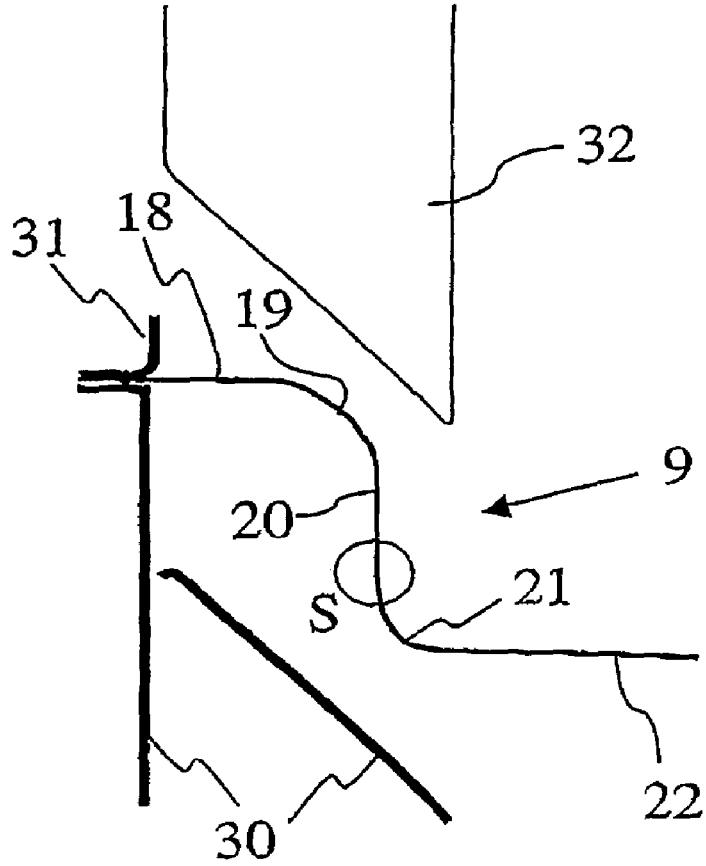

For reference to a typical top cone of the prior art, referred is to FIG. 1 schematically showing in cross section, a wall section 1 of an aerosol can, a valve cap 2, and a top cone 3. This top cone comprises a bead 4 fox holding the valve cap 2, a seamed flange 5, and a cone section 6 having an essentially spherical contour. The cone section gradually becomes wider when considered from the top downward. The seamed flange 5 and the cone section 6 are separated by a countersink section 7, which countersink section is essentially U-shaped. A bottom part of the cone section forms one of the legs of the essentially U-shaped countersink 7. The countersink part allows insertion of tooling that forms the seam 5 to get behind the material to form the join. The distance d is referred to as the countersink depth.

FIG. 2 shows a cross section representation of the contour of the top cone in a region around the countersink region 7. In the embodiment as shown, the flange section 51 has not yet been seamed. Contour A shows the contour when there is no pressure inside the aerosol can, assuming that the top cone is actually seamed to an aerosol can body. Contours B to E show successively the how the contour evolves with increasing pressure. These contours are calculated using a finite element model that takes into account local material properties. As can be seen, in the onset of reversal, the countersink rolls upwards, pivoting around the upper position of the countersink towards the seam area. The pivoting movement of the countersink section that results from pressure building up inside the aerosol can is schematically indicated by arrow 8. The spherical dome 6 offers relatively little resistance against this pivoting action.

FIG. 3 schematically denotes the top cone according to an embodiment of the invention. The drawn line represents the top cone as is may be incorporated in an aerosol can, having a bead 14 for holding a valve cap, and a seamed flange 15 for seaming onto the body of the aerosol can.

The dashed line shows how an intermediate product might look during manufacture. The top section 10 is still a closed section and the bead is not yet implemented. The flange section 11 is still flat.

The cone section 16 follows an essentially straight trajectory. This is thought to provide a degree of bracing (represented by the arrows 12) behind the countersink section, preventing it from rolling upwards during the early stages of reversal failure, and thereby increasing the pressure required to cause structural failure of the top cone.

The radius at the bottom of the countersink 17 can be reduced to further stiffen the countersink structure, with the result that during the onset of cone reversal, the countersink section remains sufficiently rigid to still pivot about the seam and retain a safe progressive plastic roll-through upon final failure of the top cone.

As well as bracing the countersink against roll through, the straight cone section gives rise to another important advantage. With the typical design according to the prior art, the long perimeter of the spherical cone uses a significant proportion of the material, fixing the overall final diameter of the top cone. Because a straight cone section takes the shortest distance between the top section and the bottom of the countersink section, the design releases a certain amount of material to make a deeper countersink for a given blank cut-diameter, retaining the original final diameter.

The top cone can be produced from a metal blank by forming. Firstly a metal blank is provided and cupped FIG. 4*a* shows the intermediate cupped blank 9. After cupping, the intermediate cupped blank has, as seen in cross section, an essentially flat top region 18, which is connected by an outwardly convex bend 19 to a side wall region 20, which side wall region is connected via an outwardly concave bend 21 to an outer region 22 that runs essentially parallel to the top region 18.

When this intermediate cupped blank 9 is further press formed into the top cone, it is possible to ensure that the outwardly concave bend 21 is flattened and that this part of the cupped blank is formed to be incorporated into the cone section of the top cone to provide the desired stress damaged region. This is illustrated in FIG. 4*b*, wherein the desired stress damaged region is schematically encircled by circle S.

Figure 4B:
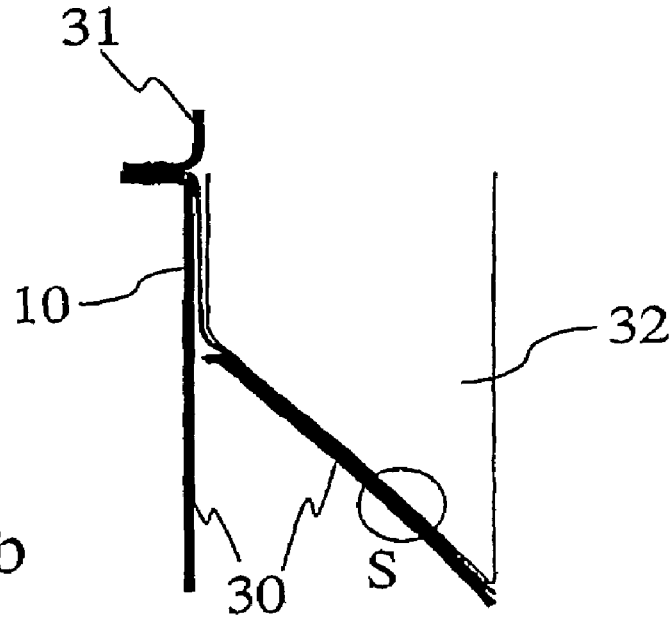

The circle S in FIG. 4*a* indicates the surprising origin of the stress damaged region S in FIG. 4*b*, as it has been determined by keeping track of the elements in a computational finite element analysis of the press forming process, similar to the one already referred to in the description of FIG. 2. It is surprisingly located just adjacent to the outwardly concave bend 21, which bend has a relatively small radius of curvature.

Alternatively, the outwardly convex bend 19 may possess a relatively small radius of curvature to provide a stress damaged region when it is flattened in the press forming process.

As is schematically indicated in FIGS. 4*a* and 4*b*, the flattening tool 32 is axially moved towards the counter tool 30, whereby the intermediate cupped blank is held in its flat top region 18 between the counter tool 30 and a pressing element 31. In the end of the forming operation, top section 10 is formed out of a part of the flat top region 18, and part of the flat top region 18 as well as the outwardly convex bend 19 is formed into the essentially straight cone section.

The function of such a stress damaged region is as follows. The stress die is thought to locally weaken the cone section. Due to the relatively weak section, the cone itself will be lifted upwards when the pressure exceeds the reversal pressure, thereby causing the cone to buckle at the position of the weaker section. Consequently, the supporting effect of the cone section on the countersink section is removed, allowing the countersink section to pivot with relative ease in a progressive plastic reversal failure. Thus the failure is still safe and controlled, despite it occurring at a much higher pressure.

Figure 5A:
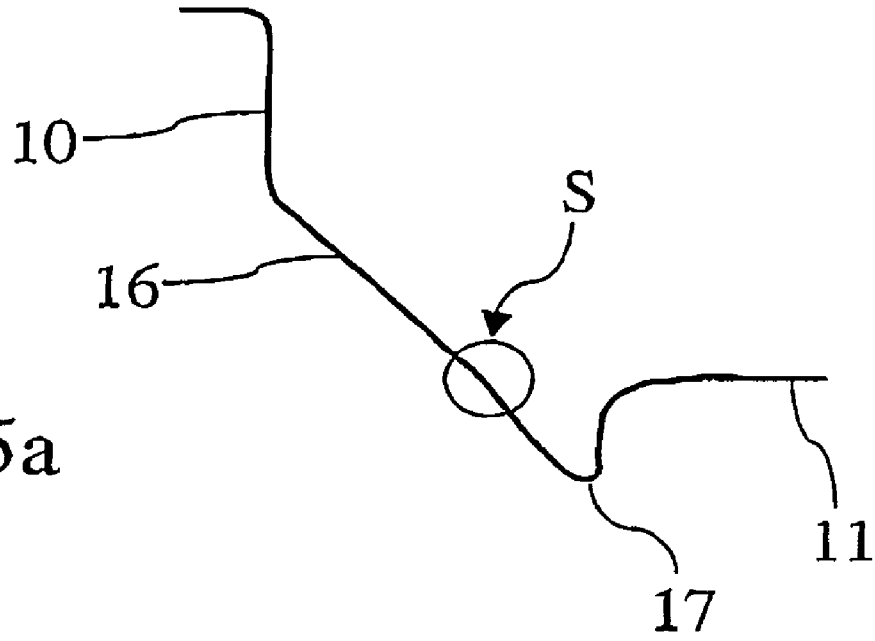
FIG. 5 shows reversal behaviour of a top cone according to an embodiment of the invention.
Figure 5B:
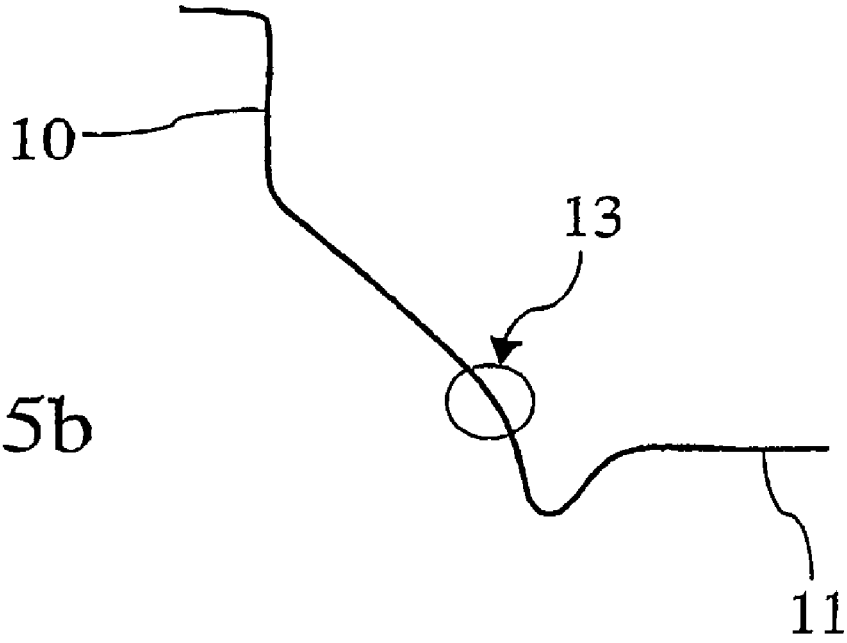

The buckling in the stress damaged region is shown in FIG. 5*b*, wherein the arrow 13 indicates the buckled region. FIG. 5*a* shows a cross section of the top cone after having been formed in accordance with FIG. 4. As can be seen, the stress damaged region S shows a slight deviation from a mathematically straight trajectory. This is a result of commonly occurring spring back when the product is released from the forming tools, if the forming tools show a straight cone trajectory. The remaining reference numerals of FIG. 5 correspond to those of FIG. 3.

Figure 6:
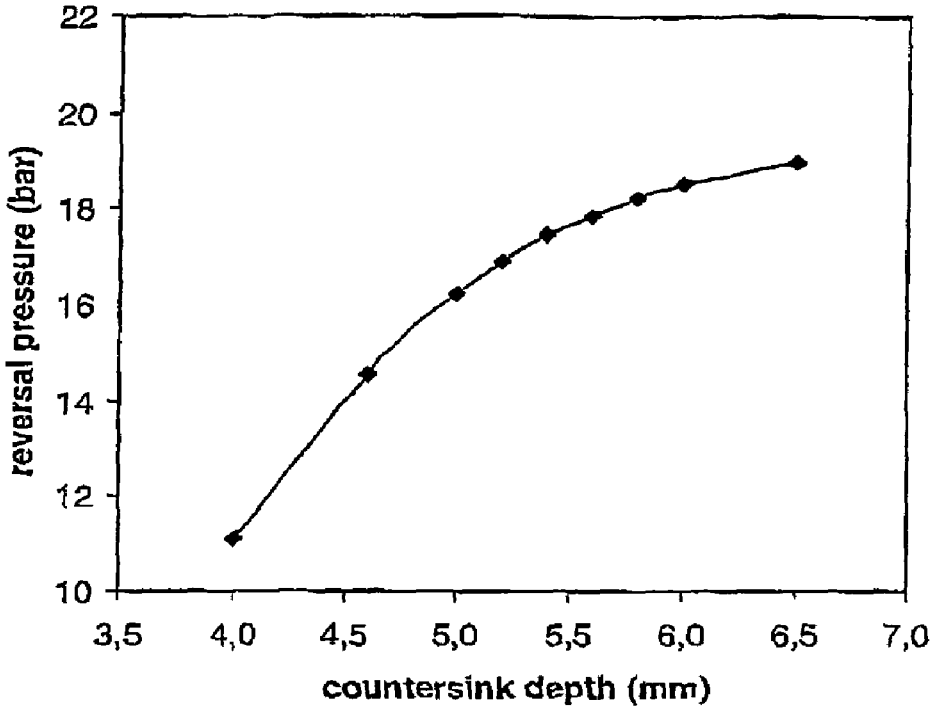
FIG. 6 is a graph showing the effect of the countersink depth on the reversal pressure.

As can be seen in FIG. 6, the countersink depth d significantly influences the aerosol top cone in terms of reversal strength. A change of as little as 1 mm may affect the reversal pressure by as much as 20%. A double improvement should thus result using the top cone having a straight cone section, with contributions to reversal strength from increased countersink depth combined with the bracing by straight cone.

Figure 7:
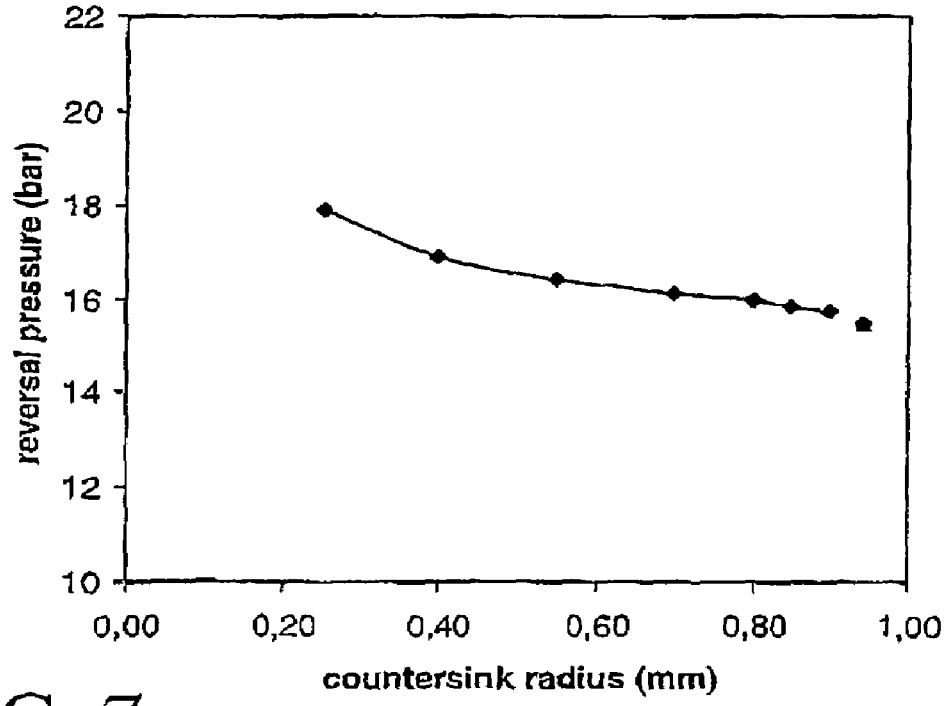
FIG. 7 is a graph showing the effect of the countersink radius on the reversal pressure.

As can be seen in FIG. 7, also the countersink radius can significantly influence the aerosol top cone in terms of reversal pressure. As can be seen, a small improvement of about 0.6 bar is observed using a radius of 0.70 mm compared to a radius of 0.95 mm. Below 0.70 mm, the effect clearly becomes stronger, and surprisingly below 0.50 mm the relative effect becomes even stronger. An improvement of about 15% is observed by reducing the countersink radius from 0.95 mm to 0.25 mm.

The cone design according to FIG. 1, having a spherical cone section 6, has a reversal strength of 15.5 bar when manufactured from packaging steel. This design has a countersink depth d of 4.8 mm, and a radius projected of 34.5 mm before flanging the seam 5.

When the same type of blank is manufactured into the cone design according to FIG. 3, having a straight cone section 16, and an equal countersink depth of 4.8 mm, the reversal pressure was found to be 17.0 bar, representing an increase of 9.8%. The final projected radius in unflanged condition is 34.9 mm.

When the countersink depth is increased to 5.3 mm to obtain the original projected radius of 34.5 mm, the reversal pressure is 19.5 bar, representing an overall improvement of 26% over the original top cone.

The blank gauge used, in the above examples is 0.32 mm. The higher reversal pressure now gives the option of reducing the blank gauge by an amount to obtain a top cone having the original 15.5 bar. It has been found that the blank gauge can be reduced by 0.04 mm to a thickness gauge of 0.28 mm, i.e. by 12.5%.

It seems fairly straight forward to implement the novel straight cone section design in existing processes, requiring relatively low cost. The top section of the cone, for instance, may remain unchanged, so that a standard valve cap can still be held.

The invention claimed is:

1. Top cone for an aerosol can, comprising:

a formed metal sheet extending around a longitudinal central axis, and having a longitudinal contour that comprises a top section downward, the top section for holding a valve cap, a cone section connected to the top section and leading to a countersink section and a flange section, the countersink section being essentially U-shape comprising a first outer leg, further from the central axis and a second inner leg, closer to the central axis, wherein the first outer leg is bent away from the central axis to form the flange section, and 0 the cone section has a continuously increasing transversal diameter, wherein the top cone comprises strengthening means extending from the countersink section to the top section for strengthening the countersink section against pivoting toward the central axis, wherein the strengthening means comprises the cone section having essentially a straight trajectory wherein a bottom part of the cone section forms the inner leg of the essentially U-shaped countersink section.

2. Top cone according to claim 1, wherein the top cone is formed from a polymer pre-coated metal blank.

3. Aerosol can comprising a body having a side wall that, on a bottom end, is provided with an end closure, and, connected to a top end of the side wall, opposite to the bottom end, the top cone according to claim 1, the top cone being provided with the valve cap.

4. Top cone according to claim 1, wherein the top cone is formed from a polymer pre-coated packaging steel blank.

5. Top cone for an aerosol can, comprising:

a formed metal sheet extending around a longitudinal central axis, and having a longitudinal contour that comprises, a top section downward, the top section intended for holding a valve cap, a cone section connected to the top section and leading to a countersink section and a flange section, the countersink section being essentially U-shape comprising a first outer leg, further from the central axis and a second inner leg, closer to the central axis, wherein the first outer leg is bent away from the central axis to form the flange section, and the cone section has a continuously increasing transversal diameter, wherein the top cone comprises strengthening means for strengthening the countersink section against pivoting toward the central axis, wherein the strengthening means comprises the cone section having essentially a straight trajectory wherein a bottom part of the cone section forms the inner leg of the essentially U-shaped countersink section, wherein the strengthening means comprises the cone section being shaped to brace the countersink section against pivoting toward the central axis, and the cone section is provided locally with an essentially circumferential weak section relative to a reminder of the cone section.

6. Top cone according to claim 5, wherein the circumferential weak section is at least partly formed by a stress damaged region.

7. Top cone for an aerosol can, comprising:

a formed metal sheet extending around a longitudinal central axis, and having a longitudinal contour that comprises, a top section downward, the top section for holding a valve cap, a cone section connected to the top section and leading to a countersink section and a flange section, the countersink section being essentially U-shape being defined by a first outer leg, further from the central axis and a second inner leg, closer to the central axis, wherein the first outer leg is bent away from the central axis to form the flange section, and the cone section has a continuously increasing transversal diameter, wherein the top cone comprises strengthening means for strengthening the countersink section against pivoting toward the central axis, wherein the strengthening means comprises the cone section having essentially a straight trajectory wherein a bottom part of the cone section forms the inner leg of the essentially U-shaped countersink section, wherein the essentially U-shaped counter sink is formed by an outwardly convex section connecting the two legs, the outwardly convex section having a relatively small radius so that the U-shaped countersink section is essentially close to a V-shape.

8. Top cone according to claim 7, wherein the radius of the convex section is smaller than 0.90 mm.

* * * * *